United States Patent [19]

Balz

[11] 4,385,472

[45] May 31, 1983

[54] UNITARY MULTIPLE CENTRIFUGAL FINISHING APPARATUS

[75] Inventor: Gunther W. Balz, Kalamazoo, Mich.

[73] Assignee: Roto-Finish Company, Inc., Kalamazoo, Mich.

[21] Appl. No.: 238,441

[22] Filed: Feb. 26, 1981

[51] Int. Cl.[3] ..... B24B 19/00

[52] U.S. Cl. ..... 51/7; 51/163.1

[58] Field of Search ..... 51/163.1, 163.2, 164.1, 51/164.2, 7

[56] References Cited

U.S. PATENT DOCUMENTS

| | | | |
|---|---|---|---|
| 2,923,104 | 2/1960 | Olson | 51/164.1 |
| 3,423,884 | 1/1969 | Balz | 51/163.1 |
| 3,624,970 | 12/1971 | Balz | 51/163.1 |
| 3,990,188 | 11/1976 | Balz | 51/163.2 |
| 3,991,524 | 11/1976 | Ferrara | 51/163.1 |

*Primary Examiner*—Harold D. Whitehead

*Attorney, Agent, or Firm*—Gordon W. Hueschen

[57] ABSTRACT

A finishing machine for finishing the surface of unfinished parts with finishing media, comprising a finishing chamber, preferably but not necessarily resiliently mounted, for receiving unfinished parts and media and for finishing of parts therein, in which the chamber comprises a bottom and includes upstanding side walls and in which the chamber bottom comprises a plurality of annular spinner members, constituting a lower portion of the chamber, and complementary annular openings for the spinner members, the spinner members being adapted to rotate about an axis which is either substantially vertical or substantially normal with respect to the section of the chamber bottom in which located, a rotational motion-producing assembly operatively associated with each of the spinner members comprising rotatable support means for each of the spinner members, each of which support means is adapted to rotate about an axis which is substantially the same as that of its complementary spinner member, and associated drive means for rotation of each of the rotatable support means, whereby each of the spinner members may be rotated with respect to its complementary opening in the chamber bottom for carrying out a finishing operation in the chamber, the chamber being either linear or annular, and optionally including exit and/or separation and/or precession means to assist with separation and/or exit of finished parts after completion of a finishing cycle within the finishing chamber, is disclosed.

34 Claims, 8 Drawing Figures

211
214
234
234
214
214
257
272
234
234
231
255
213
236
232
216
212
221
219
217

211
231
216
219
214
214
221
215
236
212
255
237
232
237
244
238
257
242
252
256
256
250
262

UNITARY MULTIPLE CENTRIFUGAL FINISHING APPARATUS

BACKGROUND OF THE INVENTION

1. Field of the Invention

Finishing machines or apparatus, centrifugal finishing apparatus which embodies means for exit of finishing media and finished parts and for separation thereof, such apparatus which is self-separating and which embodies automatic media return.

2. Prior Art

Centrifugal finishing devices have become increasingly popular during recent years because of their rapid finishing action, but efficient separation means or procedure has not previously been available for employment in or together with such centrifugal finishing devices. Accordingly, although finishing with such centrifugal finishing apparatus has to date been rapid, efficient, and relatively economical, such advantages have been lost due to the inability to provide or even conceive a suitable and satisfactorily economical separation procedure and apparatus therefor, especially one which eliminates or involves a minimum of manual labor. Moreover, it has been found that centrifugal finishing apparatus, as presently conceived and available, has definite and serious size limitations. The usual type of centrifugal apparatus cannot be extended beyond certain maximum size limits without serious disadvantages. For example, it has been found in these laboratories that, when the diameter of the spinner member in the centrifugal finishing apparatus exceeds a certain maximum, excessive variations in tolerances between the circumference of such spinner member and the complementary opening in which it is adapted to rotate occur, resulting in inadequate seals, excessive leakage of fluid and solid materials at the juncture between the periphery of the spinner member and the edge of the opening in which it is adapted to rotate, and considerable mechanical and other difficulties, including excessive down time and maintenance, then result. These shortcomings cannot be cured by improving the nature of the seal between the rotating and the stationary member, inasmuch as seals have a maximum sealing capacity and the fluctuations and variations encountered with oversized centrifugal finishing apparatus have to date eliminated any practical or economic applications requiring relatively large finishing volume or capacity, and the attendant machine size which would be most economical for such applications. Therefore, at the present time the application of centrifugal finishing apparatus has not reached its full potential due to shortcomings in separation procedure and apparatus for use in combination therewith, as well as inherent size limitations or restrictions found to exist with centrifugal finishing apparatus as its has been conceived up until the present date. It is apparent that improved centrifugal finishing apparatus and procedure, which is not characterized by the inherent shortcomings, deficiencies, and inabilities of the prior art centrifugal finishing apparatus and system, would be highly desirable and would fill a long-felt need in the art. Such apparatus is provided by the present invention, which eliminates the inherent shortcomings and deficiences of prior art centrifugal finishing apparatus and systems while retaining the most desirable characteristics and advantages thereof and adding additional advantages thereto.

As representative of prior art in this area of the surface-finishing field may be mentioned U.S. Pat. Nos. 3,435,567; 3,990,188; 4,026,075; 4,177,608; and RE 29,964.

OBJECTS OF THE INVENTION

The present invention has the following objects, inter alia: To provide a novel centrifugal finishing apparatus which is a unitary multiple centrifugal finishing apparatus, a type of apparatus never before conceived. To provide such apparatus which retains the best features of vertical centrifugal finishing apparatus and procedure as known today, while at the same time eliminating the shortcomings thereof. To provide a novel vertical centrifugal finishing apparatus which embodies a plurality of centrifugal finishing centers or sections within the finishing chamber of the finishing apparatus. To provide a novel vertical centrifugal finishing apparatus of the said type which eliminates size restrictions on the finishing apparatus involved. To provide a novel vertical centrifugal finishing apparatus which provides for parts exit, parts separation, and automatic media return, if desired. To provide such a finishing apparatus which is, if desired, truly self-separating. To provide a finishing machine in which the maximum potential of centrifugal finishing apparatus is exploited fully, but which still permits rapid and efficient separation of finished parts or workpieces from the machine without the intervention of human labor or with employment of the same to an absolute minimal extent. To provide a rapid and efficient and economical vertical centrifugal finishing machine from which finished parts may be rapidly and efficiently separated on an automatic, semi-automatic, or batch-size basis, as desired. To provide a rapid and efficient centrifugal finishing machine from which finished parts or workpieces are rapidly and efficiently exited or separated, or within which finished parts or workpieces can be rapidly separated from finishing media, and wherein finishing media can be automatically returned to the finishing chamber for reuse in a further finishing cycle, as desired. To provide an improved automatic, semi-automatic, or batch-size centrifugal finishing machine with automatic separation of finished part, a combination not heretofore available. Additional objects of the invention will be apparent to one skilled in the art, and still other objects will become apparent hereinafter.

The foregoing and additional objects are achieved by provision of the novel centrifugal finishing apparatus according to the present invention.

SUMMARY OF THE INVENTION

The invention, in summary, includes the following aspects, inter alia:

A finishing machine for finishing the surface of unfinished parts with finishing media, comprising a finishing chamber for receiving unfinished parts and finishing media and for finishing of parts therein, characterized in that said finishing chamber comprises a bottom and upstanding side walls and in that the bottom of said finishing chamber comprises a plurality of annular spinner members, constituting a lower portion of said finishing chamber, and complementary annular openings, usually substantially concentrically and/or coaxially arranged, for said spinner members, said spinner members being adapted to rotate about an axis which is generally vertical, e.g., either substantially vertical or alternatively substantially normal with respect to the section of said finishing chamber bottom in which located, a rotational motion-producing assembly operatively associated with each of said spinner members comprising rotatable support means for each of said spinner members, each of which is adapted to rotate about an axis which is substantially the same as that of its complementary spinner member, and associated drive means for rotation of each of said rotatable support means, whereby each of said spinner members may be rotated with respect to its complementary opening in the bottom of that particular finishing chamber section for carrying out a finishing operation in said chamber; such machine wherein the finishing chamber is resiliently mounted and in which the upstanding side walls of said chamber define a plurality of connected annular tub members having walls which partially surround said spinner members, each of which tub members is complementarily arranged with respect to a said spinner member, and each of said tub members if usually but not necessarily substantially coaxially or concentrically arranged with respect to a said spinner member, each annular spinner member and its complementary tub member respectively comprising lower and upper portions of a finishing chamber section; such machine which includes exit means for exit of finished parts after completion of a finishing cycle within said finishing chamber; wherein said finishing chamber is linear and wherein said plurality of spinner members and complementary openings are linearly arranged in said finishing chamber bottom; wherein the sections of said finishing chamber bottom comprising successive linearly-arranged openings and their complementary spinner members are in the form of segmented units with flexible couplings between; wherein the finishing chamber is linear and the spinner members are linearly arranged in the bottom thereof and wherein an exit opening for finished parts is located at an end thereof; wherein the individual spinner members are adapted to rotate in a complementary manner so as to advance the finishing media and parts to be finished in the finishing chamber from one end to the other end thereof; including vibratory means operatively associated with said finishing chamber for causing precession of finishing media and parts within said finishing chamber from one end thereof to the other; wherein said vibratory means is so arranged as to cause precession of said finishing media and parts from a starting section of said finishing chamber to an exit section of said finishing chamber; wherein said vibratory means is a vibratory motor; wherein said vibratory means is an oscillatory or reciprocatory device; wherein said device is annular; wherein the individual spinner members are adapted to rotate in a complementary manner so as to advance the finishing media and parts around said finishing chamber; wherein said annular device has an exit opening for exit of finished parts therefrom; wherein said annular finishing chamber has a substantially flat bottom; or wherein said annular device has an inclined bottom; wherein said plurality of said spinner members in complementary openings in said inclined bottom and said rotational motion-producing assemblies operatively associated with each of said spinner members are each adapted to rotate about an axis which is substantially normal to the section of said finishing chamber bottom in which they are located; wherein said inclined bottom comprises a step; wherein a foraminous member is provided at a level elevated with respect to said bottom of said finishing chamber following said step for separation of finished parts from finishing media; wherein said foraminous member is associated with a finished parts exit; wherein said foraminous member is adapted to be moved into separation position at an elevated level with respect to the bottom of said finishing chamber following said step for separation of finished parts from finishing material and alternatively out of said position to enable operation of the finishing process without separation; wherein said foraminous member is mounted at an elevated position with respect to the bottom of said finishing chamber following said step; wherein said foraminous member comprises a screen or grate; wherein such annular finishing chamber comprises a central column and wherein said finishing chamber comprises an interior wall surrounding said column; wherein vibratory means is located within said central column for assisting with precession of finishing media and parts around said finishing chamber during a finishing cycle; wherein vibratory means is located within said central column and adapted to assist precession of finished parts across said foraminous member and out of said machine during a separation cycle; wherein said vibratory means comprises a shaft bearing eccentric weights within said central column; wherein said vibratory means comprises an eccentric motor located within said central column; wherein said vibratory means comprises a substantially vertical shaft and eccentric weights and pulley means driven by a motor with associated pulley and belt means which is mounted on said finishing chamber or a support therefor; wherein said finishing chamber comprises, for each separate spinner member and its complementary opening in the finishing chamber bottom, an annular sealing member for sealing but rotatable engagement of each of said spinner members with said complementary openings; wherein said rotatable support means for each of said spinner members comprises a shaft which is substantially normal with respect to said finishing chamber section in which located, journaled in bearings mounted adjacent said spinner member and supported below said spinner member and said finishing chamber, and wherein said drive means comprises a motor, e.g., an electric or hydraulic motor, for driving each of said shafts; wherein said spinner members, and preferably all of said spinner members, are bowl shaped; and wherein elevation means are also provided at an end or side of said machine for assisting with movement of parts and media from one end of said finishing chamber to the other and out of an exit opening or section during a parts separation or exit cycle.

DESCRIPTION OF PREFERRED EMBODIMENTS OF THE INVENTION

The invention, in several preferred embodiments, is illustrated by the accompanying drawings, in which:

FIG. 4 is an enlarged sectional view of the apparatus of FIGS. 1–3, taken along the line 4—4 in FIG. 2.

SPECIFIC REFERENCE TO THE DRAWINGS

Reference is now made to the accompanying drawings for a better understanding of the invention, wherein all the essential parts are numbered and wherein the same numbers are used to refer to corresponding parts, or wherein the same numbers but differing by a factor of one hundred (100) are used to refer to corresponding parts, throughout.

In a preferred linear form, the finishing apparatus of the invention is shown in FIGS. 1–4. Annular versions are shown in FIGS. 5–8.

Figure 1:
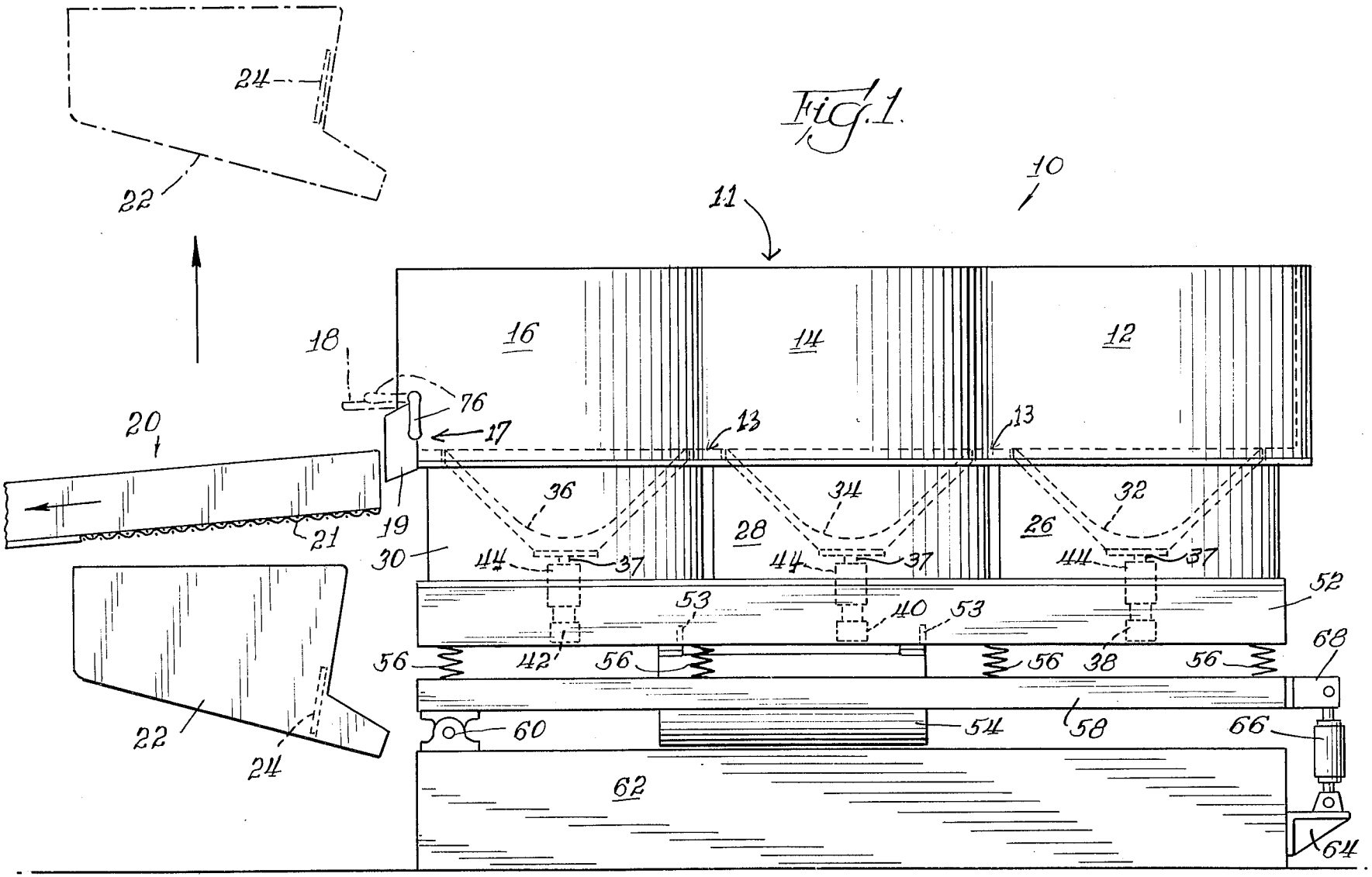
FIG. 1 is a front elevation of one form of apparatus according to the present invention.

In FIG. 1, the finishing machine of the invention is shown generally at 10, being a linear finishing machine having a starting section 12, an intermediate section 14, and a final or exit section 16, all defined by upstanding walls. Shown in broken lines below each of said finishing chamber sections is annular spinner member 32, 34, and 36, respectively, in the form of a bowl, which bowl-shaped spinner members constitute a preferred embodiment of the invention. Each of the annular spinner members 32, 34, and 36 constitutes a lower portion of one section of finishing chamber 11, which comprises complementary annular openings substantially coaxially arranged with respect to said spinner members in the bottom 13 thereof. Although not essential according to the invention, for the purposes of eliminating dead spots within the finishing chamber 11, the upstanding side walls defining finishing chamber sections 12, 14, and 16 define a plurality of connected annular tub members, each of which, as shown, is substantially coaxially and substantially concentrically arranged with respect to its respective spinner member, each annular spinner member and its complementary annular tub member respectively comprising lower and upper portions of each finishing chamber section. Each of said annular spinner members (32, 34, 36) has a rotational motion-producing assembly operatively associated therewith, and supported beneath the finishing chamber, comprising rotatable support means for each of said spinner members, as shown in the form of a shaft 37. Each of said spinner members is adapted to rotate about an axis which is substantially vertical as well as substantially normal with respect to the section of the finishing chamber bottom 13 in which it is located, and the support means 37 for each of said spinner members is likewise adapted to rotate about an axis substantially vertical and/or normal to the bottom 13 of the finishing chamber section in which its complementary spinner member is located. Each of said support members in the form of shaft 37 is journaled in bearings 46 respectively provided in bearing housings 44 (see FIG. 4) and, as shown, is adapted to be rotated by means of electric or hydraulic motors 38, 40, and 42, powered from a source not shown. In the exit section 16 of finishing chamber 11 is located a parts exit 17, associated with chute 19, which parts exit is closed by exit door 18 adapted to be manipulated exterior of the machine by door handle 76. Shown beneath respective sections 12, 14, and 16 of finishing chamber 11 are support tubes for the individual finishing chamber sections 26, 28, and 30, all of which are supported on upper frame member 52. Completing the resiliently-mounted assembly of the device of the invention is vibratory eccentric motor 54, as shown secured to frame member 52 by supports 53, which is powered from a source not shown. The entire resiliently-mounted assembly is resiliently supported on intermediate frame member 58 by springs 56, said intermediate frame member 58 being pivotally secured to lower frame member 62 by pivot means 60 at the end thereof directly below parts exit 17. Intermediate frame member 58 is adapted to be elevated at the end thereof located below finishing chamber starting section 12 by means of cylinder 66, respectively mounted to lower frame member 62 and intermediate frame member 58 by means of brackets 64 and 68.

Shown to the left of the centrifugal finishing device in FIG. 1 is a media separator 20 comprising foraminous member in the form of screen or grate 21, as shown being located adjacent exit chute 19. Below foraminous member 21 is located hopper 22 having a reload door 24 adjacent its exit chute with reload door 24 in closed position blocking said exit chute. Reload hopper 22 is also shown in dash-dot lines in reloading position with reload door 24 open for return of media collected in reload hopper 22 to finishing chamber 11.

Figures 1, 2, 3:
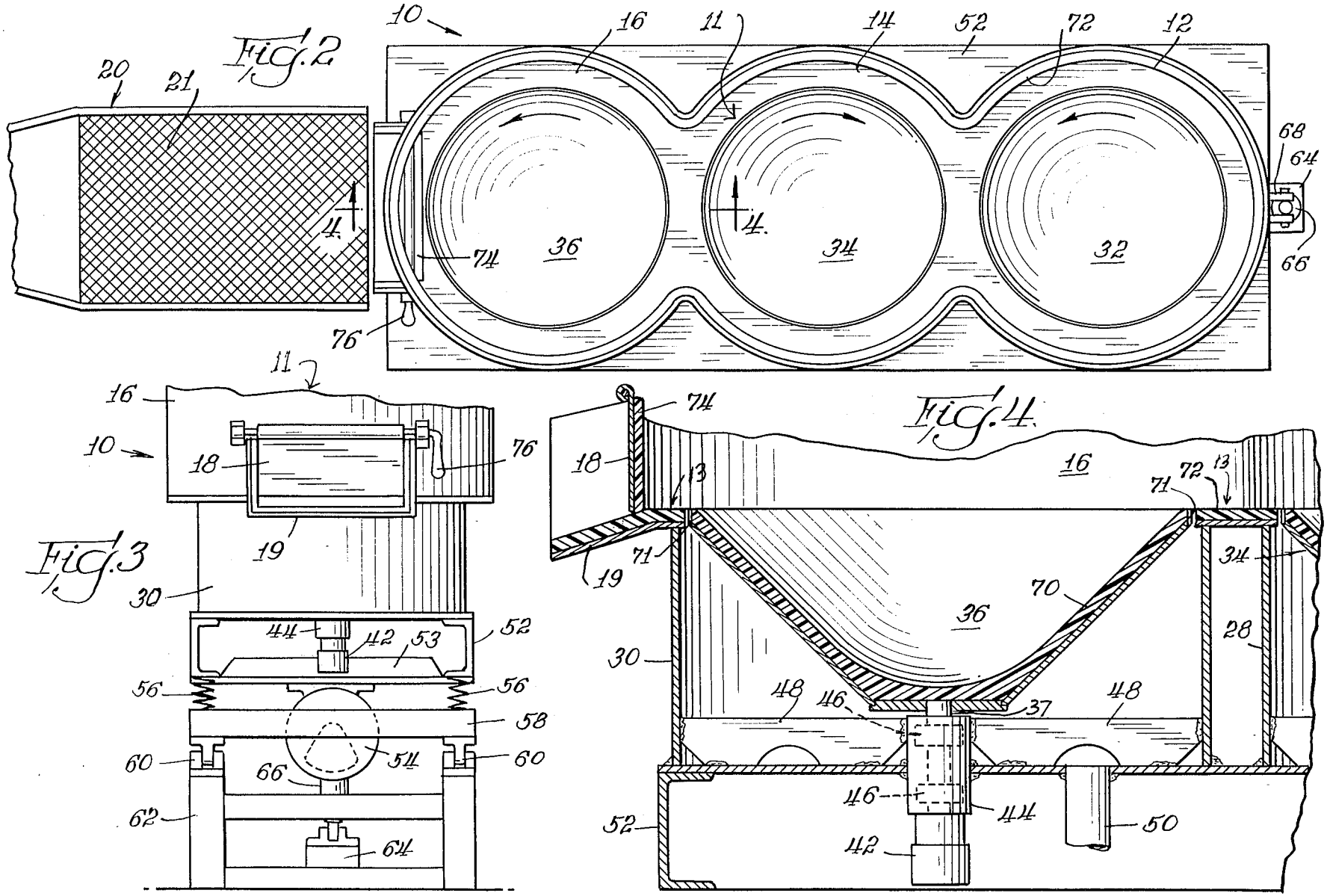
FIG. 2 is a top plan view of the finishing apparatus of FIG. 1 according to the invention.
FIG. 3 is an end view of the apparatus of FIGS. 1 and 2, viewing it from the left.

The same elements are seen in top plan in FIG. 2, which additionally shows exit door lining 74 and tub lining 72, as well as that portion of upper frame 52 which, in the embodiment shown, lies outside of the upstanding walls of finishing chamber 11 defining finishing chamber sections 12, 14, and 16. The same elements are visible in the end view of FIG. 3, together with more details in the exploded cross-section of FIG. 4, which additionally shows support plates 48 for bracing bearing housings 44, polyurethane or other elastomeric lining 74 of exit door 18, polyurethane or other elastomeric lining 72 for tub 16 and tub bottom 13, polyurethane or other elastomeric lining 70 for spinner bowl 36, and elastomeric seal 71 at the juncture of the periphery of spinner bowl 36 and the edge of its complementary opening in the bottom 13 of finishing chamber section 16. The partial cross-sections of finishing chamber sections 12 and 14 are substantially identical to that shown for finishing chamber 16 in FIG. 4, except for the presence of exit opening 17, exit door 18, and exit chute 19, all of which are of course only associated wit the final section 16 of the finishing chamber. As shown in FIG. 2, the individual spinner members 32, 34, and 36, each in its own complementary opening in bottom 13 of finishing chamber sections 12, 14, and 16, are adapted to rotate in a complementary manner so as to advance the finishing media and parts around said finishing chamber and the individual sections thereof and from one end (starting) to the other (exit) end thereof. Also, as most clearly seen from FIG. 2, the upstanding side walls of the finishing chamber 11 define a plurality of connected annular tub members 12, 14, and 16, each of which is substantially coaxially arranged with respect to its respective bowl-shaped spinner member 32, 34, and 36, each annular spinner member and complementary annular tub member constituting lower and upper portions of each of the finishing chamber sections 12, 14, and 16, respectively.

In operation of the device or apparatus shown in FIGS. 1 through 4, it is a simple matter to introduce parts to be finished and finishing media into finishing chamber 11, usually at least into starting finishing chamber section 12 and frequently into all sections including 12, 14, and 16 thereof. Any finishing media collected in reload hopper 22 from a previous finishing cycle may be returned to finishing chamber 11 by elevating hopper 22 and opening the reload door 24 thereof, allowing collected finishing media to enter into an additional finishing cycle. Actuation of motors 38, 40, and 42 causes rotation of shaft 37 in bearings 46 in bearing housings 44 and consequent rotation of associated bowl-shaped spinner members 32, 34, and 36. The parts and finishing media within the individual centrifugal sections 12, 14, and 16 of finishing chamber 11 are thereupon subjected to a finishing cycle of predetermined length, during which they are intimately admixed and surface finishing of parts occurs by virtue of the interaction of the parts and the finishing media both on a micromolecular and macromolecular scale within the respective sections of finishing chamber 11. At the end of a predetermined finishing cycle, motors 38, 40, and 42 may be inactivated or continued in operation, as desired. However, for more rapid emptying of finishing media and finished parts through exit opening 17, after opening exit door 18 by means of handle 76, precession means may be employed. Such precession means imparts vibrations to the finishing chamber 11 and the individual sections 12, 14, and 16 thereof, and may advantageously be vibratory means, such as a vibratory motor 54 shown secured by supports 53 to the floating resiliently-mounted intermediate upper frame member 52. Reciprocatory and oscillatory vibration-imparting means, according to the skill of the art, may also be employed for this purpose of causing precession of parts and media within finishing chamber 11 toward and out of exit opening 17, onto foraminous member 21 of media separator 20. Finished parts go out of media separator 20 in the direction of the arrow, while finishing media is collected in reload hopper 22 for reuse in a further finishing cycle after return to finishing chamber 11 in the manner previously indicated. If desired, to facilitate even more rapid emptying of finishing chamber 11 of finished parts or workpieces and finishing media after completion of a predetermined finishing cycle, cylinder 66 may be activated to cause elevation of intermediate frame member 58 and thereby also the starting end of the entire resiliently-mounted assembly of the machine, causing an incline toward exit opening 17 and facilitating more rapid emptying of finishing chamber 11, whether or not precession means 54 has been activated previously and whether or not bowl-shaped spinner members 32, 34, and 36 continue to rotate during the finished parts and finishing media-ejection cycle. Obviously, either precessional means 54 or spinner member means 32, 34, and 36, or both of them, may be employed during a parts-ejection cycle, with or without employment of elevation means in the form of cylinder 66, cooperating with pivot 60 or alternative elevation means. Two cylinders 66 at the two corners of frame member 52 remote from exit opening 17 may sometimes be employed to advantage.

Figure 5:
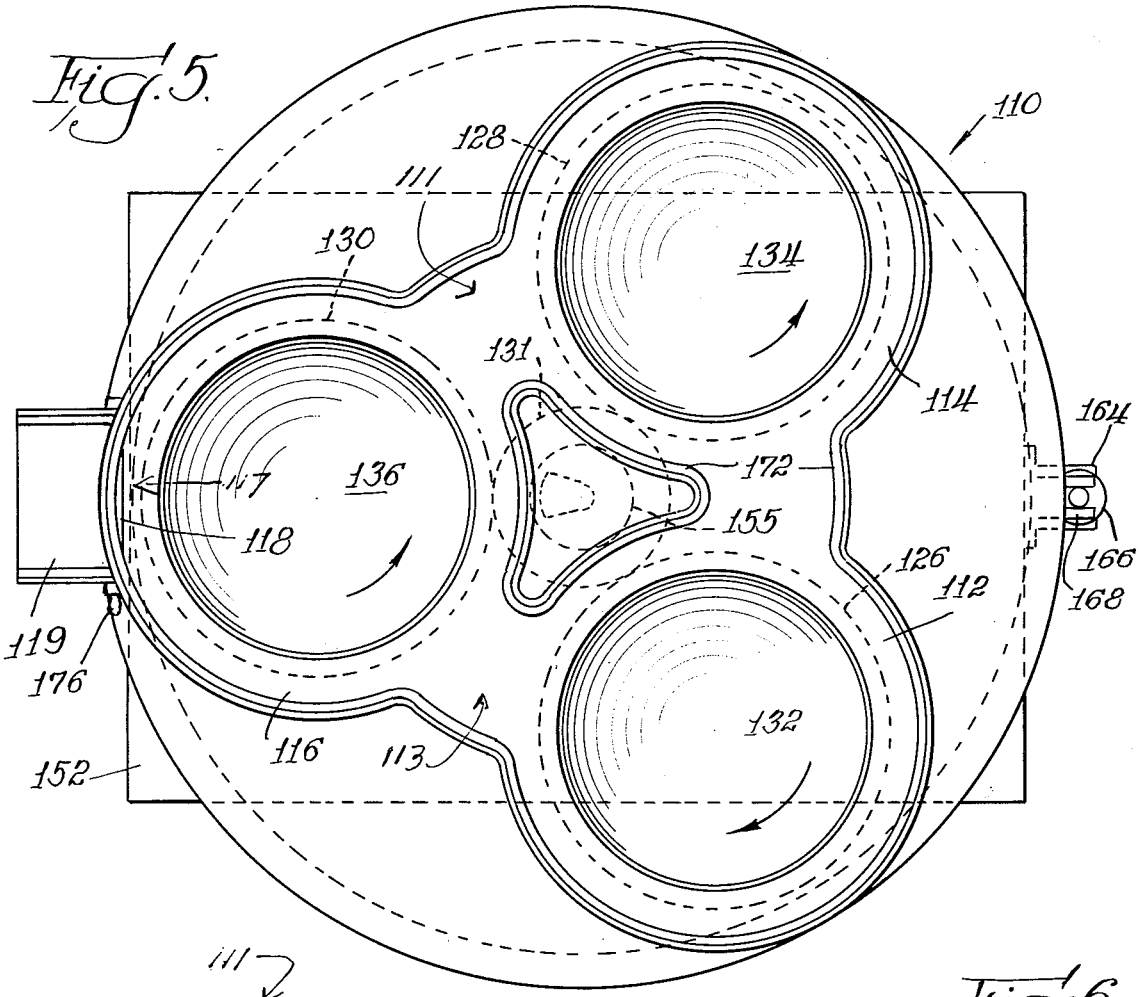
FIG. 5 is a top plan view of an annular finishing machine according to the present invention.
Figure 6:
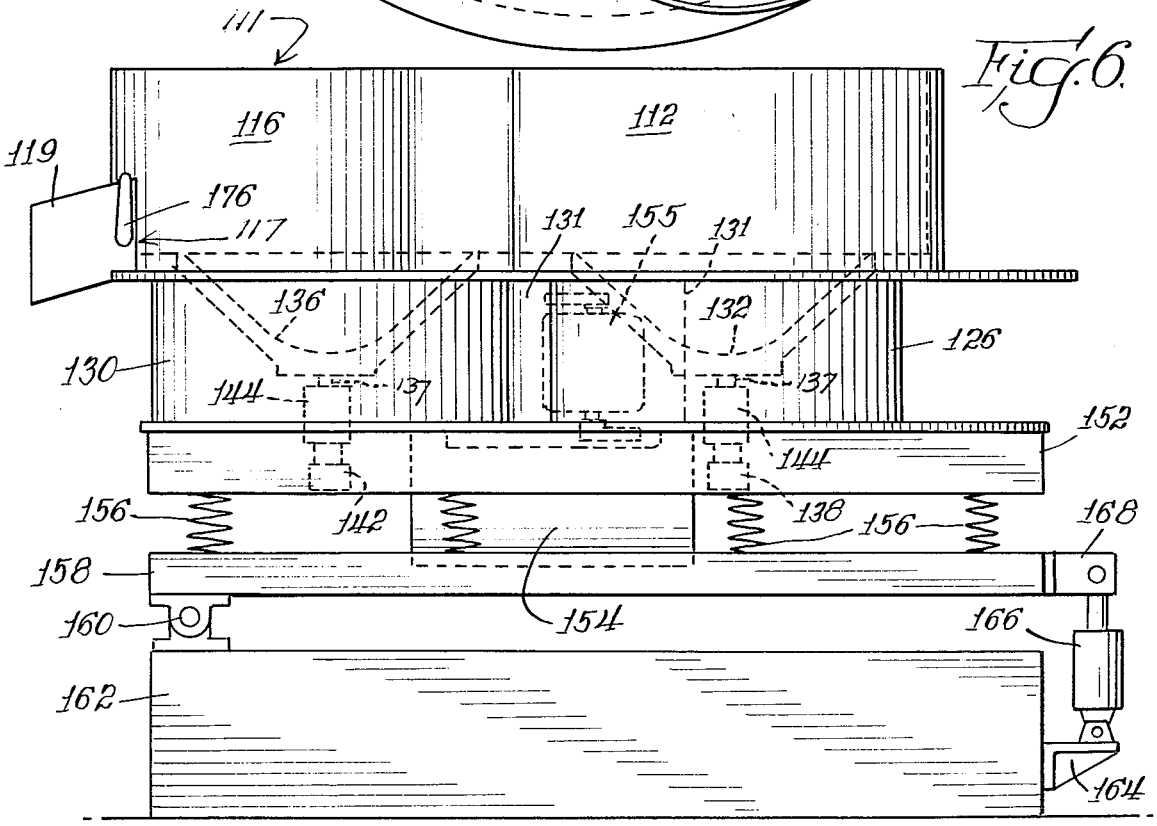
FIG. 6 is a side elevation of the finishing apparatus of FIG. 5.
Figure 7:
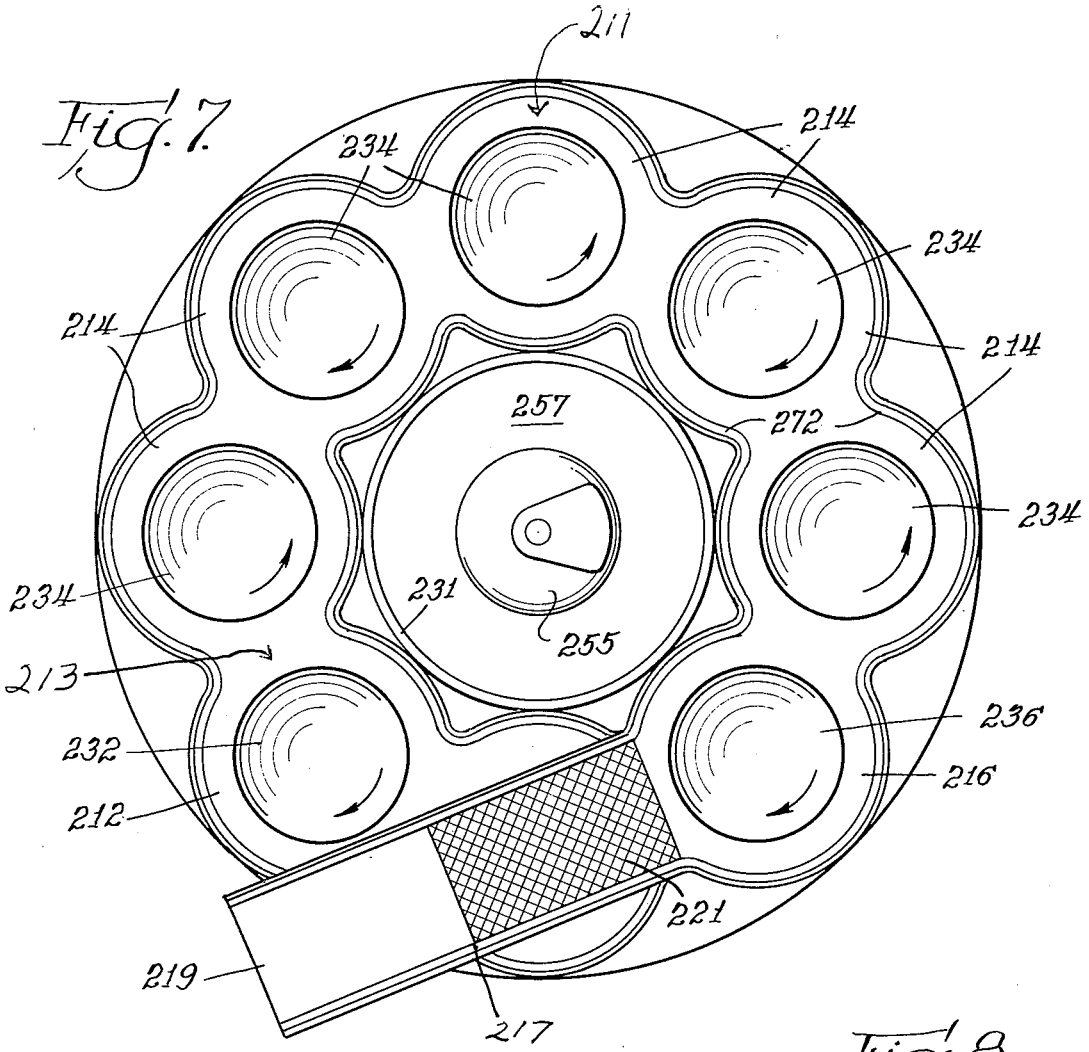
FIG. 7 is a top plan view of another annular finishing machine according to the present invention.
Figure 8:
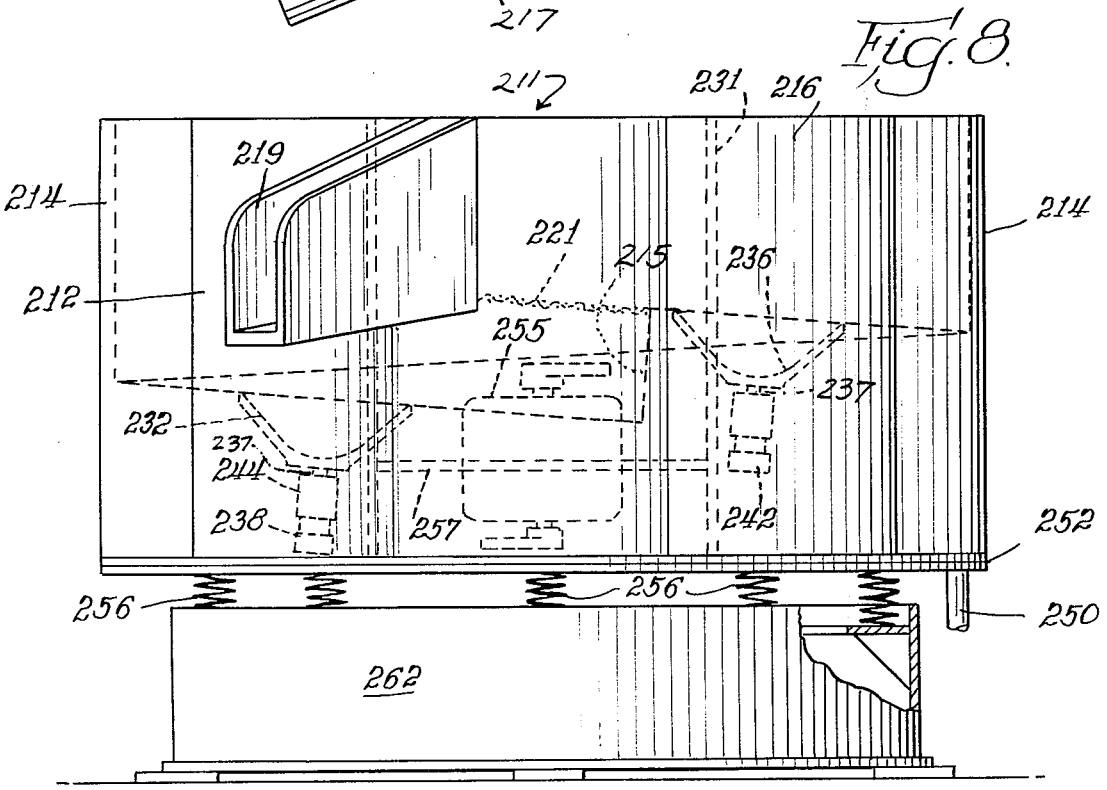
FIG. 8 is a side elevation of the finishing machine of FIG. 7.

FIGS. 5 through 8 show annular forms of apparatus according to the invention, the apparatus of FIGS. 5 and 6 having a substantially flat bottom and the apparatus of FIGS. 7 and 8 having an inclined bottom. The elements are essentially the same as for the linear device of FIGS. 1 through 4, as previously described, the device of FIGS. 5 and 6 having alternative vertical and horizontal vibratory means 155 and 154, together with parts exit 117, whereas the annular device of FIGS. 7 and 8 has vertical precessional means in the form of vibratory eccentric motor 255 together with internal foraminous member 221 in association with parts exit chute 219, as shown in place above the bottom of finishing chamber section 216 and approximately in line with step 215 in the inclined bottom thereof. As shown in FIGS. 6 and 8, the spinner members 132, 136, and 232 and 236 and their complementary support members, in the form of shafts 137 and 237, are mounted on a substantially vertical axis, which axis is also substantially normal to the section of the bottom 113 or 213 of finishing chambers 111 and 211 in which they are located. In both of these annular embodiments of the invention, it is clear that the upstanding side walls of the finishing chambers 111 and 211 define a plurality of connected annular tub members 112, 114, and 116, and 212, 214, and 216, each of which is both substantially coaxially and substantially concentrically arranged with respect to complementary spinner members 132, 134, and 136, and 232, 234, and 236, and that each combination of spinner members and its complementary tub member respectively comprises the lower and upper portions of each finishing chamber section, e.g., 112, 114, and 116 in the apparatus of FIG. 5 and 212, 214, and 216 in FIG. 7. As will be noted from the drawings, the individual spinner members in the annular devices of FIGS. 5 through 8 are rotated in the direction of the arrows and, as shown, are adapted to rotate in a complementary manner so as to advance the finishing media and parts around the finishing chamber and, when desired after a particular finishing cycle, toward or through the exit opening thereof.

The apparatus of FIGS. 5 and 6 operates essentially in the manner of the linear apparatus of FIGS. 1 through 4, with the essential difference that, upon completion of a finishing operation within finishing chamber 111 thereof, the operator has the option of actuating either horizontally-arranged precessional means in the form of vibratory eccentric motor 154 or vertically-arranged precessional means in the form of vibratory eccentric motor 155, supported by support means 131, and both powered from a source not shown.In addition, the operator has the option of permitting motors 138, 140, and 142 to operate during a parts-ejection stage. Further, the operator has the option of raising the side of the resiliently-mounted segment of the apparatus, for a parts-ejection cycle, by actuating elevation means in the form of cylinder 166. Actuation of this elevation means in the form of cylinder 166 assists with movement of parts and media from one side of said finishing chamber 111 to the other and out of exit opening 117 or final exit section 116 during a parts separation or exit cycle. Thus, numerous alternatives are available to the operator during a parts-ejection cycle, including activation of one or all of spinner members 132, 134, and 136, together with one or all of precessional means in the form of horizontally-mounted vibratory motor 154, vertically-mounted vibratory motor 155, and elevation means in the form of cylinder 166. Two separate cylinders at the corners of frame 152 remote from parts exit 117 can sometimes be employed to advantage. The finishing cycle in the device illustrated in FIGS. 5 and 6 is rapid and efficient, and the parts and media exit is equally rapid and efficient. For separation of finished parts or workpieces from finishing media, apparatus of the nature shown in FIG. 1, comprising a media separator, reload hopper, and associated lifting means for the reload hopper are of course required, inasmuch as the embodiment of FIGS. 5 and 6 makes no provision for internal separation of finishing media from finished parts or workpieces. In the device of FIGS. 5 and 6, only one precessional means 154 or 155 is frequently sufficient.

With respect to the embodiment shown in FIGS. 7 and 8, all of the elements are identical except for the presence of an internal foraminous member in the form of screen or grate 221 and centrally-mounted precessional means in the form of vibratory eccentric motor 255 is secured within the center column and within the interior upstanding walls of the finishing chamber of this annular embodiment of the invention by means of mounting plate 257 and cylindrical support means 231. As shown, foraminous member 221 is an extension of the inclined bottom 213 of the finishing chamber 211 at the end of finishing chamber section 216, constituting the final finishing chamber section. In this position, foraminous member 221 is adapted to accept finished parts from the inclined bottom 213 of finishing chamber 211 and return finishing media to the bottom 213 following step 215. This foraminous member 221 is pivotable by means not shown along its transverse axis at 217 so as to be removable out of position as an extension of bottom 213 of terminal finishing chamber section 216. When pivoted out of this position, parts and workpieces march around the finishing chamber from one section thereof to the next succeeding section, fall over step 215, and continue their finishing operation until such time as foraminous member 221 is pivoted about its axis at 217 and returned to the position shown on FIG. 8, wherein it resides as an extension of the finishing chamber inclined bottom in terminal finishing chamber section 216. For internal separation, it is not necessary that foraminous member 221 constitute an extension of the finishing chamber bottom in the separation cycle, but only that it be elevated from the bottom of the finishing chamber immediately following step 215 by an adequate margin to permit finishing material to fall through the foraminous member 221 and continue on its path along the finishing chamber 211, whereas finished parts or workpieces collect on said foraminous member 221 and march out of said finishing chamber by means of chute 219. It is again pointed out that spinner members 236 and 232, as shown in shadow lines in FIG. 8, as well as their support means in the form of shaft 237, are mounted substantially normally with respect to the section of the finishing chamber bottom 213 in which they are located and that, as usual, the walls of the finishing chamber constituting the upper tub portion of the finishing chamber sections, namely, 212, 214, and 216 constitute an upper substantially annular tub member which, in this case, is concentrically arranged with respect to its respective lower spinner member. Since the bottom 213 of the apparatus in this embodiment of FIGS. 7 and 8 is inclined, the axis is normal to the bottom of the finishing chamber section in which the spinner member and its support means are located, but accordingly swung out of the absolute vertical and to a position of substantial normality with respect to the section of the finishing chamber bottom in which the spinners are located, but the tub walls are concentric and not coaxial with regard to the spinner members.

Operation of the device of FIGS. 7 nd 8 is substantially as described in the foregoing for other embodiments of the invention, with the exception that the parts or workpieces and finishing media may be allowed to progress about the finishing chamber until a desired degree of surface finishing has been attained, whereupon the foraminous member 221 may be swung about its pivot or axis 217 into separating position, whereupon separation of finishing media from finished parts occurs, finished parts exiting from the machine via chute 219. The position of foraminous member 221 into either a separation or non-separation position with respect to step 215 can of course be controlled manually or programmed for automatic operation.

As general considerations, it will be seen from the foregoing that the axis upon which the spinner members of the invention are mounted is generally vertical. In practice, this axis is usually substantially vertical or substantially normal to the bottom of the finishing chamber section in which such spinner member is located. When the bottom of the finishing chamber is not inclined, then tha axis is usually both substantially vertical and substantially normal to the bottom of the finishing chamber section in which it is located. On the other hand, when the finishing chamber bottom is inclined, it is generally preferred that the axis be substantially normal to the bottom of the finishing chamber section in which the spinner member is located. Alternatively, however, an inclined bottom may be divided into a series of upward steps, terminating in a downward step between the finishing chamber section having the lowest bottom and the finishing chamber section having the highest bottom. In such construction, each section may have a bottom which is elevated with respect to the preceding section, and the spinner members may be mounted in the bottoms of such finishing chamber sections as usual. In such case, the axis upon which the spinner member is mounted will be both vertical as well as normal to the bottom of the finishing chamber section in which located. Although such arrangement is not preferred, it is operative especially when precessional means and/or elevational means are also present for purposes of assisting with the advancement of finishing media and parts from one end of the machine to the other and out a parts exit thereof.

Also, as a general consideration, although it is preferred that the upstanding walls of the finishing chamber define a plurality of connected tub members which are either coaxially or concentrically arranged with respect to their complementary spinner members, it is only necessary that these walls of the finishing chamber define a plurality of connected tub members which are complementarily arranged with respect to their spinner members, so that the combination of spinner member and tub member comprises lower and upper portions of a finishing chamber section. To this end, the walls of the connecting tub members need only partially surround their respective spinner members. They need not necessarily be coaxial or even concentric with their respective spinner member and, for certain applications, embodiments wherein the walls of the finishing chamber section surrounding its particular spinner member may even advantageously be oval rather than completely annular and in certain cases may be advantageously oval or annular but off-center and not concentric with the spinner member of that particular finishing chamber section. However, for practical and performance reasons, as indicated in the foregoing, the upper tub member is preferably not only annular but also either coaxial or concentric with its respective lower spinner member.

From the foregoing, it will be seen that a novel centrifugal finishing apparatus which can be made to operate in a batch-wise, semi-automatic or automatic manner, as desired, and as implemented by desired or necessary programming, has been provided. Moreover, such a novel centrifugal finishing apparatus whereby the finishing operation may be rapidly and efficiently carried out by means of a plurality of vertical centrifugal finishing sections, located within the finishing chamber of such a machine, and whereby the finishing media may be rapidly separated from finished parts and finished parts discharged from the machine, has also been provided. Such type of apparatus which is not limited by size consideration has now been made available. Such centrifugal finishing apparatus which does not suffer from the previous shortcomings of separation apparatus and procedure has now likewise been made available. Such type apparatus involving a unitary multiple centrifugal finishing apparatus, comprising a plurality of centrifugal centers or sections within a single finishing chamber, an aspect of the centrifugal finishing art not previously conceived, is now available to industry. Thus, improved and novel centrifugal finishing apparatus and procedure, not characterized by the inherent shortcomings, deficiencies, and inabilities of available prior art apparatus and systems, whereby rapid, efficient, and economical finished parts separation may be achieved, and whereby all of the additional objects of the invention may be accomplished, have been provided by the present invention.

It should be clear to one skilled in the art that various alternatives to those specifically shown herein can be employed with equal facility. For example, instead of the vibratory means 54 or 154 shown herein, comprising an eccentric motor horizontally arranged, other means of imparting vibrations to the finishing chamber of the apparatus of the invention may be employed. Representatively, standard reciprocatory or oscillatory means may be employed to impart the required vibrations instead of eccentric motor 54 or 154. Still alternatively, a shaft bearing eccentric weights and mounted horizontally, driven by a standard electric motor and supported from a portion of the frame constituting a portion of the resiliently-mounted structure of the apparatus of the invention, may be utilized. Such alternatives and equivalents are readily available and well-known to one skilled in the art. Further, as an alternative to the vertically-mounted vibratory eccentric motors 155 and 255, as specifically shown herein, a vertical shaft bearing eccentric weights and powered by a standard electric motor mounted on a portion of the resiliently-mounted structure of the apparatus of the invention, for example, the finishing chamber itself or a support therefor, e.g., a resiliently-mounted frame portion, may be employed. Such standard electric motor may be employed, along with complementary pulley and belt means, to drive a pulley associated with the vertically-mounted shaft, as is now well-known to one skilled in the art and representatively disclosed in U.S. Pat. No. 4,177,608. Additionally, the individual sections of the finishing chamber, each of which comprises the lower spinner member and the upper tub member portions, being connected to another similar unit according to the invention, need not be rigidly connected thereto. Especially in the linear versions of apparatus according to the invention, such individual finishing chamber sections may be resiliently segmented to the next succeeding and last preceding similar section, as is well-known in the art and as representatively disclosed in U.S. Pat. No. 3,624,970. Additional alternatives, variations, and equivalents of the same nature will readily present themselves to one skilled in the art to which this invention pertains.

Although each particular section of a finishing chamber of the finishing apparatus according to the present invention and its component parts, i.e., the lower spinner bowl and the upper tub portion thereof, are always generally "annular", as is any surrounding or defining wall thereof, it is not essential that such defining wall or chamber section or part thereof be annular in any precise circular sense of the term. It is only necessary that each particular section of the finishing chamber, any such part thereof, or any such defining or surrounding wall be generally annular, that is, insufficiently cornered so as to prevent the free flow of finishing media and parts to be finished therein and around the interior of the particular section of the finishing chamber involved and of the finishing chamber in general. For example (except at the juncture of the lower spinner bowl and the upper tub portion, where the annular periphery of the rotatable spinner bowl lies in opposed facing relationship to the annular lower edge of the non-rotatable tub portion, and where both must obviously be annular to permit the necessary spinner bowl rotation), such generally-annular finishing chamber section, especially upper or tub portion thereof, and any surrounding or outer or defining wall thereof, may have a decagonal, octagonal, hexagonal, or pentagonal cross-section, or any other somewhat cornered cross-section which does not detract from its generally annular nature or interfere with the flow of parts and media within the interior of a particular finishing chamber section, or the finishing chamber in general, or with rotation of the spinner member about a central and generally vertical axis. Although for purposes of ultimate convenience and operating efficiency, a truly circular annular finishing chamber section is preferred, other generally-annular finishing chamber sections may be employed with equal or only somewhat reduced efficiency, as will be apparent to one skilled in the art.

It is to be understood that the term "finishing media" is used generally herein to designate materials used to impart all types of finishes, including those finishes acquired with abrading material as well as with polishing material, and that polishing, abrading, deburring, edge-breaking, buffing, burnishing, and the like, are as usual only species of finishing. The term "finishing media", as used herein, is also intended to include all such materials which serve as loose, particulate, and solid finishing materials of the type presently employed in the trade and others of a similar nature whether natural or synthetic, including stone, porcelain, abrasive-filled clays, plastics, ceramics, wood, leather, or the like, and in any suitable shape or form as may be employed for the surface refinement and/or deburring of parts or workpieces, which are usually of metal or plastic.

It is to be understood that the invention is not to be limited to the exact details of construction, operation, or exact materials or embodiments shown and described, as obvious modifications and equivalents will be apparent to one skilled in the art, and the invention is therefore to be limited only by the full scope of the appended claims.

I claim:

1. A finishing machine for finishing the surface of unfinished parts with finishing media, comprising a finishing chamber for receiving unfinished parts and finishing media and for finishing of parts therein, characterized in that said finishing chamber comprises a bottom and upstanding side walls and in that the bottom of said finishing chamber comprises a plurality of annular spinner members, constituting a lower portion of said finishing chamber, and complementary annular openings for said spinner members, said spinner members being adapted to rotate about an axis which is generally vertical, a rotational motion-producing assembly operatively associated with each of said spinner members comprising rotatable support means for each of said spinner members, each of which is adapted to rotate about an axis which is substantially the same as that of its complementary spinner member, and associated drive means for rotation of each of said rotatable support means, whereby each of said spinner members may be rotated with respect to its complementary opening in the bottom of the finishing chamber for carrying out a finishing operation in said finishing chamber.

2. A finishing machine of claim 1, wherein the upstanding side walls of said finishing chamber define a plurality of connected tub members complementarily arranged with respect to said spinner members, each annular spinner member and its complementary tub member respectively comprising lower and upper portions of a finishing chamber section.

3. A finishing machine of claim 2 characterized in that said spinner members are adapted to rotate about an axis which is either (a) substantially vertical, or (b) substantially normal with respect to the section of said finishing chamber bottom in which located.

4. A finishing machine of claim 3, wherein said finishing chamber is resiliently mounted and wherein the upstanding side walls of said finishing chamber define a plurality of connected tub members having walls which partially said spinner members, each annular spinner member and its complementary tub member respectively comprising lower and upper portions of a finishing chamber section.

5. A finishing machine of claim 4, which includes exit means for exit of finished parts after completion of a finishing cycle within said finishing chamber.

6. A finishing machine of claim 4, wherein said finishing chamber is linear and wherein said plurality of spinner members and complementary openings are linearly arranged in said finishing chamber bottom.

7. A finishing machine of claim 6, wherein the sections of said finishing chamber bottom comprising successive linearly-arranged openings and their complementary spinner members are in the form of segmented units with flexible couplings between.

8. A finishing machine of claim 6, wherein the finishing chamber is linear and the spinner members are linearly arranged in the bottom thereof and wherein an exit opening for finished parts is located at an end thereof.

9. A finishing machine of claim 6, wherein the individual spinner members are adapted to rotate in a complementary manner so as to advance the finishing media and parts in the finishing chamber from one end to the other end thereof.

10. A finishing machine of claim 5, including vibratory means operatively associated with said finishing chamber for causing precession of finishing media and parts within said finishing chamber from one end thereof to the other.

11. A finishing machine of claim 10, wherein said vibratory means is so arranged as to cause precession of said finishing media and parts from a starting section of said finishing chamber to an exit section of said finishing chamber.

12. A finishing machine of claim 11, wherein said vibratory means is a vibratory motor.

13. A finishing machine of claim 4, wherein said finishing chamber is annular.

14. A finishing machine of claim 13, wherein the individual spinner members are adapted to rotate in a complementary manner so as to advance the finishing media and parts around said finishing chamber.

15. A finishing machine of claim 13, wherein said annular device has an exit opening for exit of finished parts therefrom.

16. A finishing machine of claim 13, wherein said annular finishing chamber has a substantially flat bottom.

17. A finishing machine of claim 13, wherein said annular finishing chamber has an inclined bottom.

18. A finishing machine of claim 17, wherein said plurality of said spinner members in complementary openings in said inclined bottom and said rotational motion-producing assemblies operatively associated with each of said spinner members are each adapted to rotate about an axis which is substantially normal to the section of said finishing chamber bottom in which they are located.

19. A finishing machine of claim 17, wherein said inclined bottom comprises a step.

20. A finishing machine of claim 19, wherein said inclined bottom comprises a step and wherein a foraminous member is provided at a level elevated with respect to said bottom of said finishing chamber following said step for separation of finished parts from finishing media.

21. A finishing machine of claim 20, wherein said foraminous member is associated with a finished parts exit.

22. A finishing machine of claim 20, wherein said foraminous member is adapted to be moved into separation position at an elevated level with respect to the bottom of said finishing chamber following said step for separation of finished parts from finishing material and alternatively out of said position to enable operation of the finishing process without separation.

23. A finishing machine of claim 20, wherein said foraminous member is mounted at an elevated position with respect to the bottom of said finishing chamber following said step.

24. A finishing chamber of claim 20, wherein said foraminous member comprises a screen or grate.

25. A finishing machine of claim 13, comprising a central column and wherein said finishing chamber comprises an interior wall.

26. A finishing machine of claim 13, wherein vibratory means is located centrally of said finishing chamber for assisting with precession of finishing media and parts around said finishing chamber during a finishing cycle or out of said machine during a parts separation or parts exit cycle.

27. A finishing machine of claim 20, having a central column and wherein vibratory means is located within said central column and adapted to assist precession of finished parts across said foraminous member and out of said machine during a separation cycle.

28. A finishing chamber of claim 26 or 27, wherein said vibratory means comprises a shaft bearing eccentric weights.

29. A finishing machine of claim 26 or 27, wherein said vibratory means comprises an eccentric motor.

30. A finishing machine of claim 26 or 27, wherein said vibratory means comprises a substantially vertical shaft and eccentric weights and pulley means driven by a motor with associated pulley and belt means which is mounted on said finishing chamber or a support therefor.

31. A finishing machine of claim 2, 6, or 13, wherein said finishing chamber comprises, for each separate spinner member and its complementary opening in the finishing chamber bottom, an annular sealing member for sealing but rotatable engagement of each of said spinner members with said complementary openings.

32. A finishing machine of claim 31, wherein said rotatable support means for each of said spinner members comprises a shaft which has an axis substantially the same as that of its complementary spinner member, journaled in bearings mounted adjacent said spinner member, and wherein said drive means comprises a motor for driving each of said shafts.

33. A finishing machine of claim 2, 6, or 13, wherein each of said spinner members is bowl shaped.

34. A finishing machine of claim 8, 10, or 15, comprising elevation means at a point in said machine spaced away from said exit opening or section of said finishing chamber for assisting with movement of said parts and finishing media from one end of said finishing chamber to the other and out of said exit opening or section during a parts separation or parts exit cycle.

* * * * *

UNITED STATES PATENT AND TRADEMARK OFFICE

CERTIFICATE OF CORRECTION

PATENT NO. : 4,385,472

DATED : May 31, 1983

INVENTOR(S) : Gunther W. Balz

It is certified that error appears in the above—identified patent and that said Letters Patent is hereby corrected as shown below:

Col. 6, line 41; "wit" should read -- with --
Col. 11, line 6; "consideration" should read -- considerations --
Col. 13, line 29; insert -- surround -- after the word "partially"

Signed and Sealed this

*Fifteenth* Day of *November 1983*

[SEAL]

*Attest:*

GERALD J. MOSSINGHOFF

*Attesting Officer*

*Commissioner of Patents and Trademarks*